United States Patent [19]

Ramachandran

[11] 4,045,358

[45] Aug. 30, 1977

[54] SOFTENER AND BLEACHING COMPOSITION

[75] Inventor: Pallassana Ramachandran, Robinsville, N.J.

[73] Assignee: Colgate Palmolive Company, New York, N.Y.

[21] Appl. No.: 614,815

[22] Filed: Sept. 18, 1975

Related U.S. Application Data

[63] Continuation-in-part of Ser. No. 366,329, June 4, 1973, abandoned.

[51] Int. Cl.[2] ..... D06M 13/46; C11D 3/60

[52] U.S. Cl. ..... 252/8.6; 8/111; 252/8.75;8.8;95;102

[58] Field of Search ..... 252/8.6, 8.75, 8.8, 252/102, 95

[56] References Cited

U.S. PATENT DOCUMENTS

| | | | |
|---|---|---|---|
| 3,494,786 | 2/1970 | Nielsen | 252/95 |
| 3,494,787 | 2/1970 | Lund et al. | 117/100 |
| 3,591,405 | 7/1971 | McCarty | 252/8.8 |
| 3,689,424 | 9/1972 | Berg et al. | 252/8.75 |
| 3,749,674 | 7/1973 | Jones et al. | 252/95 |

*Primary Examiner*—John Kight, III

*Attorney, Agent, or Firm*—Herbert S. Sylvester; Murray M. Grill; Norman Blumenkopf

[57] ABSTRACT

A non-yellowing fabric softening composition having improved whitening properties comprising a cationic softener, preferably a quaternary ammonium softener, and a perphthalic acid in the weight ratio of 4:1 to 1:1 of cationic:perphthalic acid.

10 Claims, No Drawings

SOFTENER AND BLEACHING COMPOSITION

This application is a continuation-in-part of my application Ser. No. 366,329 filed June 4, 1973, now abandoned.

The present invention relates to a softening composition which effectively prevents the discoloration and/or yellowing of fabrics with no differentiation in the softening properties thereof.

The use of various and diverse chemical materials, and particularly cationic compounds as softeners for textile products, is very well known in the art. It is also well known to employ such materials for their softening effect during the laundering operation and particularly in the rinse cycle of the laundering process. This technique has been necessitated by the fact that the softeners heretofore employed, being mainly cationic in nature, are not compatible with the major type of detergent used in the washing cycle. By far, the predominating type of detergent used in home laundering processes is anionic in nature. It has been found that even traces of anionic materials results in a precipitate which greatly reduces the effectiveness of said cationic fabric softeners. This manifestation of incompatibility has necessitated the use of cationic quaternary softeners during laundering in the rinse cycle after several rinses to free said laundered fabrics of traces of anionic detergent.

Another serious disadvatange of cationic softening agents and particularly the quaternary ammonium compounds is the well known tendency of textiles treated therewith to yellow and discolor.

It has now been found that the addition of minor amounts of perphthalic acid to cationic softening agents eliminates aforesaid yellowing the discoloration and enhances the whiteness of fabrics treated therewith, without adversely affecting the softening properties thereof. Instant composition may be used either in the wash or rinse cycle, but optimum results are obtained with rinse cycle use.

Accordingly, a primary object of this invention is the provision of a cationic fabric softening composition devoid of fabric discoloration tendencies.

Another object of this invention is to provide a fabric softening composition devoid of any yellowing tendency.

Still another object of this invention is to provide a fabric softening composition possessing superior whiteness properties.

Other objects will appear hereinafter as the description proceeds.

In accordance with the above objects, the fabric softening composition of this invention comprises a cationic softener and a perphthalic acid in the weight ratio of 4:1 to 1:1 of cationic:perphthalic acid.

The cationic fabric softening compounds useful in the composition of the present invention are commercially known and comprise cationic nitrogen containing compounds, such as quaternary ammonium compound and amines containing one or two straight chain organic radicals of at least 8 carbon atoms and preferably containing at least one straight chain organic radical containing from 12 to 22 carbon atoms.

Generally, the quaternary ammonium softening agents have the following formulas:

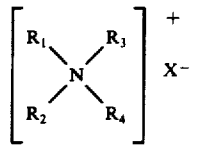

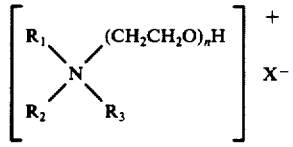

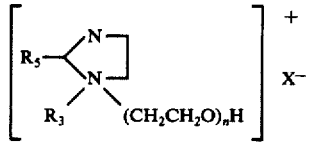

wherein $R_1$ is a long chain aliphatic radical having from 18 to 22 carbon atoms, $R_2$ is a long chained aliphatic radical having from 18 to 22 carbon atoms, $R_3$ and $R_4$ are lower alkyl radicals, e.g., $C_1$ to $C_4$, $R_5$ is long chain aliphatic radical of from 12–27 carbon atoms, $n$ is a number between 1 and 15 and X is a water-soluble salt forming anion, such as a halide, i.e., chloride, bromide, iodide; a sulfate, acetate, hydroxide, methosulfate or similar inorganic or organic solubilizing mono- or dibasic radical. Examples of quaternary ammonium softening agents suitable for use in the composition of the present invention include the following: hydrogenated ditallow dimethyl ammonium chloride, ethoxylated ($n=3$) distearyl methyl ammonium chloride, 1-hydroxyethyl-1-methyl-2-heptadecyl imidazolinium chloride; 1-hydroxyethyl-1-ethyl-2-tridecylimidazolinium bromide; 1-hydroxyethoxy-1-methyl-2-pentadecyl imidazolinium methosulfate; dimethyl distearyl ammonium chloride; di-coco dimethyl ammonium chloride; distearyl dimethyl quaternary ammonium bromide; distearyl dimethyl quaternary ammonium methylsulfate; dicoco dimethyl quaternary ammonium chloride; dimethyl arachidyl, behenyl quaternary ammonium chloride; di(soya) dimethylammonium chloride, and di(coco) dimethylammonium chloride.

Examples of amines which may be utilized in the composition of the present invention include primary tallow amine, primary coco amine, primary helogenated tallow amine, n-tallow 1,3-propylene diamine, oleyl 1,3-propylene diamine and coco 1,3-propylene diamine.

The term "coco" when utilized refers to fatty acid groups formed in coconut oil fatty acids. Such acids contain from about 8 to 18 carbon atoms per molecule predominating in the $C_{12-14}$ acid.

An essential ingredient in instant softening composition is an organic peroxygen compound such as a perphthalic acid, more specifically diperisophthalic acid (DIPA). The encapsulated DIPA is available (Suprox) as a white, free-flowing odorless, grandular solid containing 4% active oxygen, about 25% DIPA, about 48% $MgSO_4$ and about 27% water of hydration, with a particle size such that 98% passes through a 14 mesh sieve while 95% is retained on an 80 mesh sieve (sieve sizes are U.S. standard).

A particularly useful form of the DIPA is the stabilized material containing an alkali metal or alkaline earth metal salt of a highly ionized acid, such as the sulfate, and especially the material encapsulated with a hydrated salt as described in Lund and Nielsen U.S. Pat. No. 3,494,787 and Nielsen U.S. Pat. No. 3,494,786, both issued Feb. 10, 1970. A product of this type is sold under the name "Suprox" and is described in a 39 page bulletin entitled "Suprox Active-Oxygen Bleach" issued May 1970 by the Commercial Development Department, PPG Industries Industrial Chemical Division. These patents and bulletin mention that the encapsulated DIPA may be mixed with detergent formulations such as heavy-duty household laundering products. However, its use with cationic fabric softeners to effect a non-yellowing softening composition is unexpected.

Another patent describing stabilized percarboxylic acids and admixtures thereof with synthetic detergents is French Pat. No. 1,181,892.

Although it is well known that conventional cationic fabric softeners tend to cause yellowing and discoloration of fabrics, it has nevertheless been found that minor amounts of aforesaid perphthalic acid admixed with aforesaid cationic softeners unexpectedly reduces and/or eliminates said fabric yellowing and discoloration and enhances the whitening properties thereof, without interfering with the softening properties of said cationic fabric softeners. The strong affinity of cationic fabric softeners to fabric yields superior softening properties but has the disadvantage of building up on the fabric, thereby causing undesirable yellowing normally associated therewith. It has been found that the presence of minor amounts of perphthalic acid substantially decreases the tendency of build-up of the cationic agent on the fabric, thereby eliminating yellowing. Similarly, the presence of organometallic complexes (color bodies) in the wash and/or rinse water, which is believed to be the major cause of fabric discoloration, is effectively prevented from depositing on the fabric due to the presence of minor amounts of perphthalic acid in the cationic softening composition. Weight ratios of 4:1 to 1:1 of cationic perphthalic acid appear to be most effective as a non-yellowing softening composition.

The process of treating fabrics with instant softening compositions is not dependent on temperature and performs well with either cold or warm rinse solutions. Also, the process can be conducted using water of any reasonable degree of hardness, although obviously, the use of softer rinse water is preferred.

The softening composition of instant invention may also include minor amounts of brighteners, bluing, germicides, perfumes, diluents or other additives which do not interfere with the softening and whitening properties of said composition.

This product may be prepared simply by dry blending the ingredients. It also may be prepared in liquid form such as an aqueous solution. The amount of cationic softener present in the liquid composition may be within the range of 2–20%, and preferably about 4–15% by weight. The liquid composition may be sprayed on, or otherwise agglomerated with particles of carrier materials such as borax, sodium carbonate, sodium bicarbonate, sodium sesquicarbonate, sodium sulfate, sodium chloride, phosphate salts, or the like to form granular or powdered compositions. This solid product may also be formed into a pellet or other suitable shape. The amount of cationic softener present in the powdered form may be 2–30%, and preferably 4–20% by weight.

The invention has found its greatest utility thus far in the softening of cotton fabrics, fabrics made of other cellulosic fibers, e.g., rayon or other textile fibers, e.g., nylon, silk, wool, polyethylene terephthalate, cellulose acetate, acrylonitrile polymers or copolymers, or blends of any two or more of these fibers (e.g., cotton-polyester blends). This softening composition may be applied to the fabric in an aqueous bath, either as a final rinse during laundering, or as a separate and distinct softening operation. In addition, since this softening composition is compatible with anionic and non-ionic detergents, it may be added to the wash water during laundering. However, optimum whiteness is obtained when utilized in the rinse cycle of laundering. In use, 30 to 60 g of the softening composition is added to an automatic washing machine or similar treating both containing 17 gallons (65 liters) of water, and an average load of fabrics (about 6 to 8 pounds). However, lesser or greater amounts may be utilized to obtain the desired degree of softeness and whiteness, depending on the water temperature, the amount of water and clothes, etc.

The following examples are given to further illustrate this invention. All parts given are by weight unless otherwise indicated. In the Examples, the pressure is atmospheric unless otherwise indicated.

EXAMPLE 1

Several swatches of cotton terry towel, cotton PP and Polyester/cotton PP (PP = Permanent Press finish) are washed and rinsed in water containing 1 ppm each of Fe, Cu, Mn; 150 ppm of Ca/Mg as $CaCO_3$ and 5 ppm Tannin (impurities found in water) at 120° F. Said swatches are washed with an aqueous solution of a heavy duty detergent comprising 10% sodium linear tridecyl benzene sulfonate, 2% $C_{14}$–$C_{15}$ fatty alcohol with an average of 11 ethylene oxide groups, 2% mixed sodium coconut/tallow fatty acid soap, 35% pentasodium tripolyphosphate, 7% sodium silicate ($Na_2O$:$SiO_2$ ratio 1:2.35), 0.5% sodium carboxymethyl cellulose and the balance sodium sulfate in the concentration of 1g/liter of aforedefined water. Said washed fabrics are subsequently rinsed with instant softening composition comprising 0.1g distearyl dimethyl ammonium chloride and 0.1g "Suprox" (25% diperisophthalic acid encapsulated in 75% hydrated magnesium sulfate) per liter of water. The effectiveness of the rinse composition is determined by reflectance readings (Rd) on the fabrics after rinsing, using a Gardner Color Difference Meter, wherein higher Rd values is indicative of increased whiteness and higher -*b* values indicates greater yellowness whereas higher -*b* values represents more whitening. The *b* scale goes from blue to white to yellow ($-b \rightarrow +b$).

TABLE I

| Fabric | Distegryl dimethyl quaternary ammonium chloride Final Rd | Quaternary Suprox Final Rd |
|---|---|---|
| Cotton terry towel | 67.1 | 76.2 |
| Polyester/cotton PP | 75.1 | 82.6 |
| Cotton PP | 74.6 | 81.1 |

The increased whiteness is clearly evident with the composition of instant invention, wherein the amount of DIPA is as low as 0.025 g/l of rinse water and the weight ratio of cationic to perphthalic acid is 4:1 respectively.

EXAMPLE 2

The softening composition comprising a 4:1 ratio of cationic:DIPA in the concentration of 0.125 g/l water is added to the wash cycle together with 1g/l of the heavy duty detergent composition of Example 1. The artificial water of Example 1 is used. Table II records the Rd and *b* values after wash and rinse.

TABLE II

| | Cotton Terry Towel | | Polyester/ Cotton PP | | Cotton PP | |
|---|---|---|---|---|---|---|
| | Rd | b | Rd | b | Rd | b |
| Detergent quaternary softener of Example 1 | 75.7 | −2.6 | 82.1 | −0.1 | 79.3 | −4.0 |
| | 74.8 | −2.9 | 81.7 | −0.0 | 79.4 | −3.9 |
| Detergent quaternary softener of Example 1 | 76.9 | −1.2 | 83.3 | −0.3 | 79.9 | −4.0 |
| | 75.6 | −1.1 | 82.6 | −0.2 | 79.3 | −4.0 |

The above results are indicative of only a slight improvement in whiteness when utilizing the suprox in the wash cycle during laundering.

EXAMPLE 3

Terry towel swatches were rinsed in the artifial water of Example 1 at 120° F. containing I—0.1g/l distearyl dimethyl quaternary ammonium chloride; II—0.1g/l said quaternary plus 0.1g/l magnesium sulfate; or III—0.1g/l quaternary 0.1g/l Suprox and were evaluated on the Rd scale.

TABLE III

| I | II | III |
|---|---|---|
| 67.8 | 65.8 | 80.6 |

This clearly shows the superior whiteness obtained by the composition containing Suprox plus cationic as against the cationic per se. It further shows that the superior whiteness is due to the DIPA constituent of Suprox and not the magnesium sulfate content therein. The terry towel rinsed with the Suprox-cationic exhibited greater softness than the other rinsed towels.

EXAMPLE 4

Prewashed swatches, in accordance with the procedure of Example 1 were rinsed with a composition containing 0.1g/l cationic of Example 1 and 0.1g/l perborate; and another composition containing 0.1g/l cationic and 0.1g/l percarbonate (inorganic per-oxygen bleaches) compared with a swatch rinsed in a composition containing 0.1g/l Suprox plus 0.1 g/l cationic.

TABLE IV

| | distearyl dimethyl quaternary ammonium chloride (catonic) | | Cationic Suprox | | Cationic Perborate | | Cationic Percarbonate | |
|---|---|---|---|---|---|---|---|---|
| Fabric | Rd | b | Rd | b | Rd | b | Rd | b |
| Terry | 67.9 | 1.4 | 76.3 | 2.6 | 64.1 | 5.7 | 67.8 | 6.3 |
| towel | 68.6 | 1.3 | 77.4 | 2.6 | 66.2 | 5.1 | 70.8 | 5.0 |
| Polyester/ | 72.1 | 0.8 | 78.7 | 1.2 | 72.9 | 3.2 | 76.5 | 2.9 |
| cotton PP | 71.2 | 0.8 | 77.9 | 1.7 | 74.2 | 3.1 | 74.6 | 3.5 |

The superior whitening effect of instant composition comprising the cationic quaternary compound and the organic per-oxygen bleach, such as diisoperphthalic acid in comparison to the in-organic per-oxygen bleach such as perborate and percarbonate is clearly evident from the results in Table IV.

EXAMPLE 5

Tallow alkyl propylene diamine was substituted for the distearyl dimethyl quaternary ammonium chloride in the rinse water of Example 1. Some beneficial effect on reducing color body deposition (fabric discoloration) is noted herewith. However, the composition containing the quaternary and DIPA exhibits greater whitening propensities.

EXAMPLE 6

Example 1 is repeated using the following weight ratios of distearyl dimethyl ammonium chloride to Suprox (based on 0.1 g/l of quat compound)

| | |
|---|---|
| 6(a) | 2:3 |
| 6(b) | 2:5 |
| 6(c) | 7:8 |
| 6(d) | 1:2 |
| 6(e) | 1:4 |

Excellent softness is obtained in each instance with improved whiteness comparable to the results in Example 1.

EXAMPLE 7

Example 6 is repeated using again 0.1 g/l quaternary ammonium compound and 0.8g/l Suprox (ratio 1:8); on active basis ratio is 1:2). There is a decided decrease in softening.

EXAMPLE 8

Examples 1 and 6 are repeated using the following quaternary ammonium compounds.

| | Repeat of Ex. | Quat Compound |
|---|---|---|
| (a) | 1 | dimethyl arachidyl behenyl quaternary ammonium chloride |
| (b) | 6a | " |
| (c) | 6b | " |
| (d) | 6c | " |
| (e) | 6d | " |
| (f) | 6e | " |
| (g) | 1 | hydrogenated ditallow dimethyl ammonium chloride |
| (h) | 6a | " |
| (i) | 6b | " |
| (j) | 6c | " |
| (k) | 6d | " |
| (l) | 6e | " |
| (m) | 1 | 1-hydroxyethyl-1-methyl-2-heptadecyl imidazolinium chloride |
| (n) | 6a | " |
| (o) | 6b | " |
| (p) | 6c | " |
| (q) | 6d | " |
| (r) | 6e | " |

Results comparable to Example 1 are obtained in each instance.

EXAMPLE 9

Examples 1 and 6 are repeated using cetyl trimethyl ammonium chloride in place of the dimethyl distearyl ammonium chloride. In each instance, the softening is inferior. On a scale of 1 to 10, with 5 representing softening which is just discernible to a layman, and 10 outstanding softeness, the ratings of Example 1 and 6 are from 8 to 10 while the ratings in this Example are from 2 to 3.

As is apparent from the foregoing examples, the composition and process of the present invention provides a softening composition which reduces the yellowing caused by cationic softening agents and increases whiteness with no apparent differentiation in the degree of softening.

While various preferred embodiments of the present invention have been illustrated by means of specific examples, it is to be understood that the present invention is in no way to be deemed as limited thereto, but should be construed as broadly as all or any equivalents thereof.

What is claimed is:

1. A non-yellowing fabric softening composition comprising a. a quaternary ammonium compound selected from the group consisting of those having the formulae:

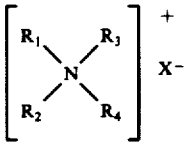

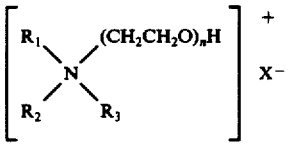

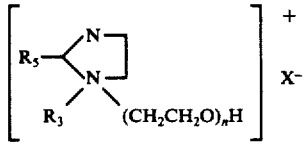

wherein $R_1$ is a long chain aliphatic radical having from 18 to 22 carbon atoms, $R_2$ is a long chained aliphatic radical having from 18 to 22 carbon atoms, $R_3$ and $R_4$ are lower alkyl radicals, e.g. $C_1$ to $C_4$, $R_5$ is long chain aliphatic radical of from 12–22 carbon atoms, *n* is a number between 1 and 15 and X is a water soluble salt forming anion, b. and a perphthalic acid bleach in a weight ratio of (a) to (b) of from 4:1 to 1:1.

2. A composition as defined in claim 1 where (a) is a water-soluble dimethyl distearyl ammonium salt.

3. A composition as defined in claim 2 wherein (b) is diperisophthalic acid.

4. A composition as defined in claim 1 wherein (a) is a water-soluble 1-hydroxyethyl-1-methyl-2-heptadecyl imidazolinium salt.

5. A composition as defined in claim 4 wherein (b) is diperisophthalic acid.

6. A composition as defined in claim 3 wherein the ratio of (a) to (b) is about 4:1.

7. A composition as defined in claim 5 wherein the ratio of (a) to (b) is about 4:1.

8. In the process of softening fabrics, the improvement which comprises treating the fabrics with an aqueous solution of the composition of claim 1, in an amount sufficient to soften said fabrics

9. A composition as defined in claim 1 wherein (b) is stabilized with an alkali metal or alkaline earth metal salt of a highly ionized acid.

10. A composition as defined in claim 9 wherein (b) is encapsulated with a hydrated salt of said alkali metal or alkaline earth metal salt of a highly ionized acid.

* * * * *